United States Patent [19]

Capp

[11] Patent Number: 4,684,200

[45] Date of Patent: Aug. 4, 1987

[54] PRESS FIT CABLE TERMINATION FOR PRINTED CIRCUIT BOARDS

[75] Inventor: Randolph E. Capp, Mechanicsburg, Pa.

[73] Assignee: AMP Incorporated, Harrisburg, Pa.

[21] Appl. No.: 797,053

[22] Filed: Nov. 12, 1985

[51] Int. Cl.[4] ..... H01R 17/18

[52] U.S. Cl. ..... 439/387; 439/84; 439/63; 439/578

[58] Field of Search ..... 339/220 R, 220 M, 221 R, 339/221 M, 186 M, 177 R, 177 E, 17 C, 17 LC, 95 R, 95 A, 276 T, 278 T

[56] References Cited

U.S. PATENT DOCUMENTS

| | | | |
|---|---|---|---|
| 3,193,792 | 7/1965 | Shea, Jr. | 339/276 T |
| 3,418,623 | 12/1968 | Ruehlemann | 339/278 T |
| 3,774,142 | 11/1973 | Siegler | 339/95 R |
| 4,125,308 | 11/1978 | Schilling | 339/177 R |
| 4,191,440 | 3/1980 | Schramm | 339/17 C |
| 4,453,796 | 6/1984 | Monroe | 339/177 R |
| 4,513,499 | 4/1985 | Roldan | 339/221 M |
| 4,519,667 | 5/1985 | Canning et al. | 339/186 M |
| 4,548,453 | 10/1985 | Mummey et al. | 339/17 C |

OTHER PUBLICATIONS

AMP Incorporated; Catalog 83-719; Aug. 1984, pp. 3, 4, 13, 14, 19 and 20.

*Primary Examiner*—Eugene F. Desmond
*Assistant Examiner*—David Pirlot

[57] ABSTRACT

A coaxial cable termination 10 for attachment to a printed circuit board 14 includes an arrangement of pins 30 with bifurcated center sections 43 to permit pressure attachment to the board 14. The termination 10 also includes a pin 16 located along the axis of a coaxial jack 16. The pin 16 also may be adapted with a bifurcated construction 43 to permit pressure attachment to the board 14.

19 Claims, 6 Drawing Figures

PRESS FIT CABLE TERMINATION FOR PRINTED CIRCUIT BOARDS

FIELD OF THE INVENTION

This invention relates to an electrical coaxial connector for press fit mounting to a printed circuit board.

BACKGROUND OF THE INVENTION

An electrical connector for press fit mounting is known from U.S. Pat. No. 4,396,245. The known connector includes a removable dust cover that holds electrical contacts, also known as electrical terminals, in an insulative housing until the terminals are inserted into corresponding apertures of a printed circuit board. The terminals of the known connector are known from U.S. Pat. No. 4,186,987. Such terminals are provided with laterally enlarged central sections that have been laterally enlarged by outwardly bulging portions of the central sections that are alongside lengthwise slits that bifurcate respective central sections. The laterally enlarged portions of the terminals frictionally engage in the apertures with an interference fit, known also as a press fit. The housing is used to apply forces on the terminals and urge the terminals collectively into respective apertures of the printed circuit board.

There is a need for a connector which holds terminals in place without a dust cover during press fit insertion of the terminals in corresponding apertures. Further there is a need for terminals that are capable of assembly into a connector and capable of withstanding forces applied by the connector to insert the terminals into corresponding apertures of a printed circuit board.

SUMMARY OF THE INVENTION

According to one aspect of the invention, an electrical connector termination structure is formed with a conductive base and a connector portion in the form of an electrical jack. Electrical terminals in the form of elongated pins are mounted in the base and in the jack and are constructed for press fit insertion into corresponding apertures of a printed circuit board, hereafter called a PC board. The base includes recesses facing the PC board.

The base includes recesses facing the PC board. A pin resident in each recess includes a protruding portion for insertion into apertures through the thickness of the PC board. The protruding portion of each pin has a spread apart bifurcated, center portion designed to fit snugly into a corresponding aperture when the base is moved toward the PC board. The base itself conveniently may be used as the tool for applying the requisite pressure to insert the pins.

Each pin has a head and shoulder configuration. The shoulder allows the pin to seat securely against a bearing surface in the recess and includes vertical slots cut into the periphery of the shoulder to bite into the softer metal of the base. The head of each pin is of irregular cross section (i.e., hexagonal) to permit alignment of pins in embodiments requiring alignment.

The jack of the termination structure also may include a bifurcated pin of the type described for forming a snug connection to the PC board. All the pins are constructed to project through the PC board and are exposed at the opposite face of the PC board to permit gang soldering if required.

DETAILED DESCRIPTION

Figure 1:
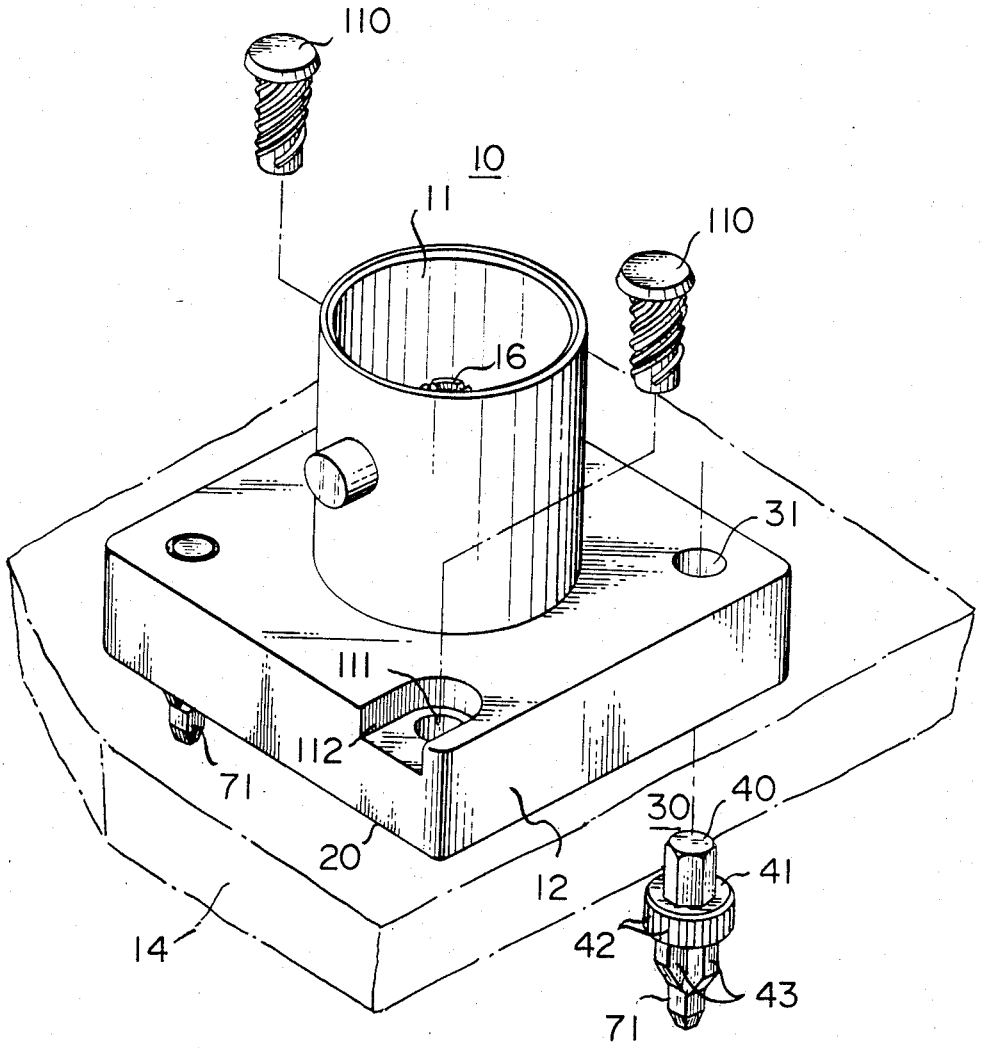
FIG. 1 is an enlarged perspective view, partially exploded, of a termination structure in accordance with one aspect of this invention.
Figure 3:
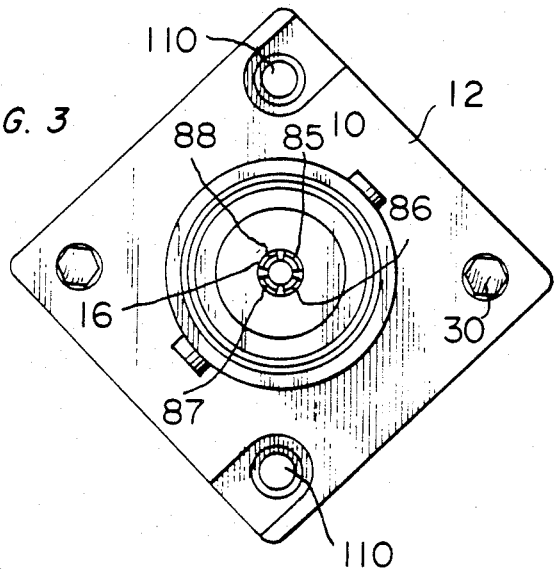
FIGS. 2 and 3 are cross section and top views of the termination structure of FIG. 1.
Figure 2:
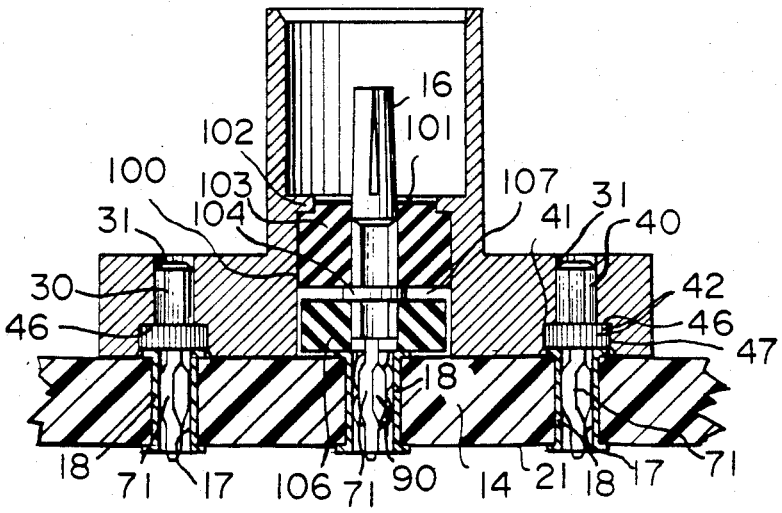

FIG. 1 shows a PC board termination structure 10 comprising a sleeve-shaped electrical jack 11 projecting from a base portion 12 having a relatively large bearing surface area as shown in FIGS. 1 and 2 as an inverted and conductive T-shaped structure. The termination structure 10, and more specifically, the jack 11, is adapted for connection to a complementary electrical connector, of the plug type as disclosed in U.S. Pat. No. 4,165,911.

Figure 4:
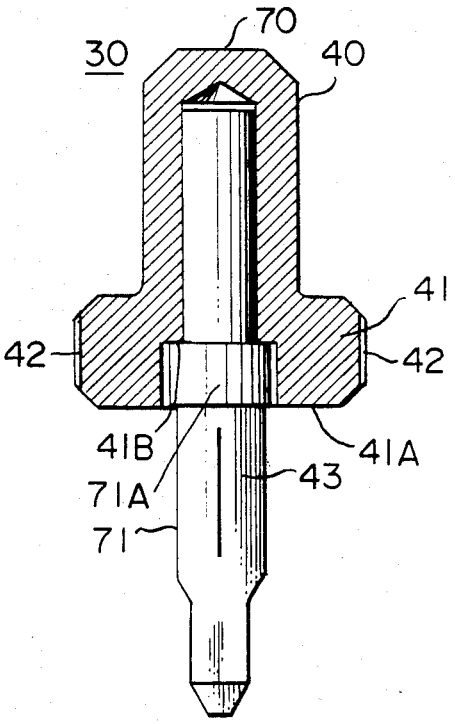

A conductive and elongated electrical terminal 30 is shown in FIGS. 1 and 4. The terminal 30 includes a conductive pin 71 having a bifurcated and widened section 43 for insertion with a press-fit in an aperture of a PC board. Further details of the section 43 are disclosed in U.S. Pat. No. 4,186,987.

An enlarged collar 71A projects laterally of the axis of the pin 71. A conductive cap 70 of the terminal 30 is hollow and is assembled over an elongated top portion of the pin 71, with the bifurcated section 43 projecting from a bottom wall 41A of the cap 40. An inverted shoulder 41B projects in the interior of the cap 70 and overlies and bears against the collar 71A. The shoulder 41B is surrounded concentrically by a relatively massive, enlarged cylindrical collar 41. The cylindrical periphery of the collar 41 is concentric with the axis of the pin 71 and is provided with a series of axially extending stirations 42 that provide a series of axially extending edges between the stirations 42. A radially collapsible hollow top portion 40 of the cap 70 concentrically surrounds the top portion of the pin 71 and is radially collapsed to frictionally engage and retain the pin 71. The external surface of the top portion 40 is hexagonal for ease in gripping the terminal 30 and orienting the terminal 30 as desired. The radial collapse of the top portion 40 is accomplished, for example, by forging between compression dies, not shown, that also form the hexagonal outer surface.

The base portion 12 includes stepped diameter apertures 31 extending axially with respect to the receptacle 11 and adapted for receiving corresponding terminals 30. An inverted depth stop shoulder 46 in the interior of each aperture 31 is impinged by a corresponding collar 41 of a terminal 30. The edges between the stirations 42 imbed partially in an enlarged diameter interior wall section 47 of the base portion 12 which can be fabricated from a metal that is softer than the cap 70.

Figure 5:
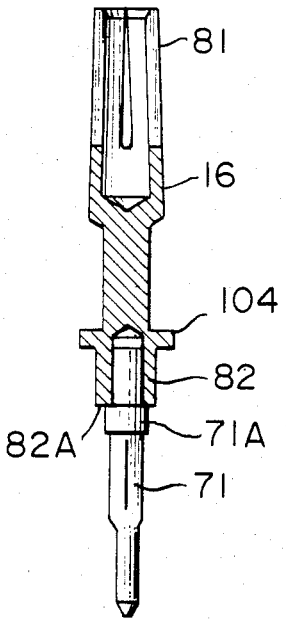
FIGS. 4, 5 and 6 are cross section and top views of alternative pin assemblies for the structure of FIG. 1.
Figure 6:
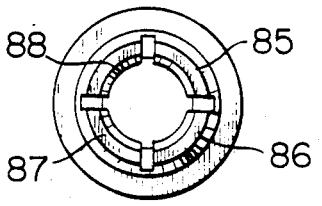

A conductive center contact terminal 16 is shown in FIGS. 1 and 5. The terminal 16 includes a conductive pin 71 identical to that used in the terminal 30. A cap portion 82 of the terminal 16 is hollow and concentrically surrounds the top portion of the pin 71. An inverted shoulder 82A of the cap portion 82 impinges against the collar 71A of the pin 71. The cap portion 82 is radially collapsed to engage and frictionally retain the pin 71. The radial collapse of the portion 82 is accomplished, for example, by forging between compression dies, not shown. The cap portion is formed with an integral external and radially enlarged collar 104. Integral with the collar and projecting axially of the pin 71 is an electrical receptacle portion 81 of the jack type electrical connector 11 for detachable connection to a plug type electrical connector, for example, disclosed in U.S. Pat. No. 4,165,911.

As shown in FIG. 2, the terminal 16 is assembled within an axial bore of a resiliently compressible dielectric body 103 that has an inverted shoulder impinging the collar 104 of the terminal 16. The terminal 16 is assembled in the axial bore of another resiliently compressible dielectric body 106 that impinges an inverted shoulder of the collar 104. The termination structure 10 has a stepped axial bore 100 extending through the sleeve form jack 11 and through the base portion 12. The annulus 103 and the annulus 106 are mounted in the bore 100, with the interior surface of the bore 100 frictionally retaining the bodies 103 and 106, and defining an annular air space 107 surrounding the collar 104. An annular, radially projecting collar 102 on the interior surface of the jack 11 provides an inverted shoulder for impinging against the body 103.

Although the terminals 30 and 16 may be assembled one at a time into the termination structure 10, an alternate method of assembly involves the steps of assembling the dielectric bodies 103 and 106 over the terminal 16, axially aligning the terminals 30 and 16 in fixed upright positions, for example, on a fixture, not shown, and then aligning the termination structure over the terminals 30 and 16, followed by pressing the terminals 30 and 16 collectively toward the termination structure 10, until the terminals 30 and 16 impinge the shoulders 56 and 102, respectively. To complete the assembly, nails 100 having enlarged heads and ribbed shanks are frictionally set into corresponding openings 111 that extend through the thickness of the base portion 12. Initially the nails 110 do not protrude below the base portion 12. Recesses 112 communicate with respective openings 111 and allow the nails 110 to be driven into corresponding apertures in the PC board 14 with the enlarged heads of the nails recessed into the recesses 112.

The assembly of the terminals into a PC board will now be explained. The PC board 14 has apertures 17 respectively positioned in axial alignment with the pins 71. The apertures 17 are lined with conductive electrical circuits 18 that are associated with the PC board 14. The pins are inserted and urged into press fit retention in corresponding apertures, using the termination structure itself as the insertion tool. Nails 110 are then driven into the PC board to anchor the termination structure 10 to the PC board.

Other modifications and embodiments of the invention are intended to be covered by the appended claims. For example, the ends of the pins 71 that project beyond the inverted surface of the PC board may be soldered to the circuits 18 and conductive wires may be wrapped snugly around the projecting ends of the pins 71 to establish wrapped wire connections.

What is claimed is:

1. An electrical connector for coaxial cable and for attachment to a circuit board, comprising, a sleeve portion and a base portion, said sleeve portion including first and second means for coupling to a signal and a ground conductor, respectively, of a coaxial cable, said first and second means being spaced apart and electrically insulated from one another, said base portion constructed with a bottom surface for abutting against said circuit board along a top surface thereof, said base portion including at least a first and a second recess therein exposed at said bottom surface, first and second pins within said recesses, each said pin including a bifurcated center section extending beyond said bottom surface for insertion into said circuit board, said bifurcated center section being adapted to fit snugly within an associated aperture in said circuit board in response to an axial force on a corresponding said pin applied thereto upon insertion into said circuit board, each said pin is widened at a corresponding said bifurcated section for press fit within said associated aperture, each said pin having a hexagonal head portion for permitting orientation of said pin in said associated recess, each said pin having a circular shoulder portion, each said shoulder portion having a periphery with axially aligned striations therein, each said associated recess having a stepped structure for providing a bearing surface for a corresponding said shoulder portion and a snug fit at said periphery adapted to conform to said striations to resist rotation of the corresponding pin.

2. In an electrical connector comprising, a conductive base, a conductive jack connector portion projecting in a first direction from the base and surrounding concentrically a dielectric material, a first collar on the interior surface of the jack connector portion engaged against the dielectric material, a conductive center contact surrounded concentrically by the dielectric material, the center contact and the base having corresponding electrical terminals, the terminals having corresponding first portions connected either to the corresponding center contact or to the corresponding base, and remainders of the terminals projecting from the base in an opposite direction from the first direction, the improvement comprising, bifurcated and widened portions on said remainders of the terminals, a second collar on the exterior of the center contact, said dielectric material comprising a first dielectric body and a second dielectric body engaged against the second collar and defining an air space surrounding the collar, the first collar providing an inverted shoulder impinging against the first dielectric body, and the second dielectric body being concentrically surrounded by the base.

3. An electrical connector as recited in claim 2, wherein the improvement further comprises, striations on the first portions of the terminals and engaged in the base.

4. An electrical connector as recited in claim 2, wherein the improvement further comprises, grippable top portions of the terminals having noncylindrical shapes for determining the orientations of the terminals.

5. In an electrical connector comprising, a conductive base, a conductive jack connector portion projecting in a first direction from the base and surrounding concentrically a dielectric material, a first collar on the interior surface of the jack connector portion engaged against the dielectric material, a conductive center contact surrounded concentrically by the dielectric material, the center contact and the base having corresponding electrical terminals, the terminals having corresponding first portions connected either to the corresponding center contact or to the corresponding base, and remainders of the terminals projecting from the base in an opposite direction from the first direction, the improvement comprising, bifurcated and widened portions on said remainders of the terminals, a second collar on the exterior of the center contact, said dielectric material comprising a first dielectric body and a second dielectric body engaged against the second collar and defining an air space surrounding the collar, the first collar providing an inverted shoulder impinging against the first dielectric body, the second dielectric body being concentrically surrounded by the base, striations on the corresponding first portions of the terminals connected to the base, the striations engaged in the base, the terminals connected to the base provided with grippable top portions having noncylindrical shapes for determining the orientations of said terminals, and inverted shoulders defined by stepped diameter apertures in the base, said inverted shoulders being impinged against corresponding enlarged portions of the terminals connected to the base.

6. In an electrical connector comprising, a conductive base, a conductive jack connector portion projecting in a first direction from the base and surrounding concentrically a dielectric material, a first collar on the interior surface of the jack connector portion engaged against the dielectric material, a conductive center contact surrounded concentrically by the dielectric material, the center contact and the base having corresponding electrical terminals, the terminals having corresponding first portions connected either to the corresponding center contact or to the corresponding base, and remainders of the terminals projecting from the base in an opposite direction from the first direction, the improvement comprising, bifurcated and widened portions on said remainders of the terminals, a second collar on the exterior of the center contact, said dielectric material comprising a first dielectric body and a second dielectric body engaged against the second collar and defining an air space surrounding the collar, the first collar providing an inverted shoulder impinging against the first dielectric body, the second dielectric body being concentrically surrounded by the base, and fasteners mounted in respective openings extending through the base, the fasteners having enlarged head portions engaged against the base and ribbed shank portions extending in said opposite direction for projection from said base together with said remainders of the terminals.

7. An electrical connector as recited in claim 6, wherein the improvement further comprises, recesses in a surface of the base aligned with the openings and receiving the enlarged head portions upon engagement thereof with the base.

8. In an electrical connector comprising, a conductive base, a conductive jack connector portion projecting in a first direction from the base and surrounding concentrically a dielectric material, a first collar on the interior surface of the jack connector portion engaged against the dielectric material, a conductive center contact surrounded concentrically by the dielectric material, the center contact and the base having corresponding electrical terminals, the terminals having corresponding first portions connected either to the corresponding center contact or to the corresponding base, and remainders of the terminals projecting from the base in an opposite direction from the first direction, the improvement comprising, bifurcated and widened portions on said remainders of the terminals, a second collar on the exterior of the center contact, said dielectric material comprising a first dielectric body and a second dielectric body engaged against the second collar and defining an air space surrounding the collar, the first collar providing an inverted shoulder impinging against the first dielectric body, the second dielectric body being concentrically surrounded by the base, striations on the first portions of the terminals and engaged in the base, and fasteners mounted in respective openings extending through the base, the fasteners having enlarged head portions engaged against the base and shank portions extending in said opposite direction for projection from said base together with said remainders of the terminals.

9. An electrical connector as recited in claim 8, wherein the improvement further comprises, recesses in a surface of the base aligned with the openings and receiving the enlarged head portions upon engagement thereof with the base.

10. In an electrical connector comprising, a conductive base, a conductive jack connector portion projecting in a first direction from the base and surrounding concentrically a dielectric material, a first collar on the interior surface of the jack connector portion engaged against the dielectric material, a conductive center contact surrounded concentrically by the dielectric material, the center contact and the base having corresponding electrical terminals, the terminals having corresponding first portions connected either to the corresponding center contact or to the corresponding base, and remainders of the terminals projecting from the base in an opposite direction from the first direction, the improvement comprising, bifurcated and widened portions on said remainders of the terminals, a second collar on the exterior of the center contact, said dielectric material comprising a first dielectric body and a second dielectric body engaged against the second collar and defining an air space surrounding the collar, the first collar providing an inverted shoulder impinging against the first dielectric body, the second dielectric body being concentrically surrounded by the base, grippable top portions of the terminals having noncylindrical shapes for determining the orientations of the terminals, and fasteners mounted in respective openings extending through the base, the fasteners having enlarged head portions engaged against the base and shank portions extending in said opposite direction for projection from said base together with said remainders of the terminals.

11. An electrical connector as recited in claim 10, wherein the improvement further comprises, recesses in a surface of the base aligned with the openings and receiving the enlarged head portions upon engagement thereof with the base.

12. In an electrical connector comprising, a conductive base, a conductive jack connector portion projecting in a first direction from the base and surrounding concentrically a dielectric material, a first collar on the interior surface of the jack connector portion engaged against the dielectric material, a conductive center contact surrounded concentrically by the dielectric material, the center contact and the base having corresponding electrical terminals, the terminals having corresponding first portions connected either to the corresponding center contact or to the corresponding base, and remainders of the terminals projecting from the base in an opposite direction from the first direction, the improvement comprising, bifurcated and widened portions on said remainders of the terminals, and fasteners mounted in respective openings extending through the base, the fasteners having enlarged head portions engaged against the base and ribbed shank portions extending from the enlarged head portions and in said opposite direction for projection from said base together with said remainders of the terminals.

13. An electrical connector as recited in claim 12, wherein the improvement further comprises, striations on the first portions of the terminals and engaged in the base.

14. An electrical connector as recited in claim 12, wherein the improvement further comprises, the terminals connected to the base having grippable top portions having noncylindrical shapes for determining the orientations of said terminals.

15. An electrical connector as recited in claim 12, wherein the improvement further comprises, a second collar on the exterior of the center contact, said dielectric material engaged against the second collar, and said first collar providing an inverted shoulder impinging against the dielectric material.

16. An electrical connector as recited in claim 15, wherein the improvement further comprises, recesses in a surface of the base aligned with the openings and receiving the enlarged head portions upon engagement thereof with the base.

17. An electrical connector as recited in claim 15, wherein the improvement further comprises, striations on the first portions of the terminals and engaged in the base.

18. An electrical connector as recited in claim 12, wherein the improvement further comprises, recesses in a surface of the base aligned with the openings and receiving the enlarged head portions upon engagement thereof with the base.

19. An electrical connector as recited in claim 18, wherein the improvement further comprises, striations on the first portions of the terminals and engaged in the base.

* * * * *